US011160330B1

(12) United States Patent
Tseng

(10) Patent No.: US 11,160,330 B1
(45) Date of Patent: Nov. 2, 2021

(54) MAGNETIC BUCKLE

(71) Applicant: Duraflex Hong Kong Limited, Hong Kong (CN)

(72) Inventor: Ming Yen Tseng, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/077,282

(22) Filed: Oct. 22, 2020

(51) Int. Cl.
*A44B 11/25* (2006.01)

(52) U.S. Cl.
CPC ..... *A44B 11/25* (2013.01); *A44D 2203/00* (2013.01)

(58) Field of Classification Search
CPC ..... A44B 11/25; A44D 2203/00; Y10T 24/32
See application file for complete search history.

(56) References Cited

U.S. PATENT DOCUMENTS 9,101,185 B1 * 8/2015 Greenberg ..... H01F 7/0263
10,085,521 B2 * 10/2018 Chen ..... A45C 13/1069
10,143,270 B2 * 12/2018 Fiedler ..... A44B 11/2588
10,376,022 B2 * 8/2019 Duncan ..... A44C 5/2071
D917,333 S * 4/2021 Duncan ..... H01F 7/0263 D11/87
2012/0044031 A1 * 2/2012 Ninomiya ..... A44B 11/2596 335/219
2019/0357641 A1 * 11/2019 Duncan ..... H01F 7/0263
2020/0229547 A1 * 7/2020 LeMarbe ..... A44B 11/005

* cited by examiner

*Primary Examiner* — Robert Sandy
*Assistant Examiner* — Louis A Mercado
(74) *Attorney, Agent, or Firm* — Collard & Roe, P.C.

(57) ABSTRACT

A buckle assembly has a first buckle portion that cooperates with a second buckle portion. Each of the buckle portions has a base body with exterior surfaces, interior surfaces that extend from a central circular flat, a fastening hook on one longitudinal end and a fastening opening with a first fastening wedge on another longitudinal end on an opposite side of the circular flat from the fastening hook, and a magnet under the circular flat. Placing the interior surfaces of the first buckle portion against the interior surfaces of the second buckle portion causes the magnets to engage each other and the fastening hooks of each buckle portion to enter the fastening openings of the other buckle portion, to lock the two buckle portions together and prevent disengagement under tension in opposing directions parallel to a longitudinal extent of the buckle assembly.

7 Claims, 6 Drawing Sheets

MAGNETIC BUCKLE

BACKGROUND OF THE INVENTION

1. Field of the Invention

This invention relates to a magnetic buckle. In particular, the invention relates to a two-piece sliding buckle that is held in place by cooperating magnets on each of the pieces.

2. The Prior Art

Two-piece buckles are often used to connect two straps together, such as in a seat belt. Often, the buckles are locked together via a spring-loaded latching mechanism, which can be released by raising or lowering a latch, or by pressing a button.

SUMMARY OF THE INVENTION

It is an object of the invention to provide a two-piece buckle assembly that is simple to engage and disengage, and which does not require moving parts, such as springs or hinges, yet remains secure under tension.

This and other objects are accomplished by a buckle assembly having a first buckle portion that cooperates with a second buckle portion. Each of the buckle portions has a base body with a plurality of exterior surfaces, and a plurality of interior surfaces that extend from a central circular flat, a fastening hook on one longitudinal end of the base body and a fastening opening with a first fastening wedge on another longitudinal end of the base body on an opposite side of the circular flat from the fastening hook, and a magnet enclosed in the base body under the circular flat. The first and second buckle portions are configured such that placing the interior surfaces of the first buckle portion against the interior surfaces of the second buckle portion causes the magnets to engage each other and the fastening hooks of each buckle portion to enter the fastening openings of the other buckle portion, to lock the two buckle portions together and prevent disengagement under tension in opposing directions parallel to a longitudinal extent of the buckle assembly.

The fastening wedge is connected to the base body and extends into the fastening opening on each of the first and second buckle portions. The fastening hooks engage a respective one of the fastening wedges as the fastening hooks enter the opening to lock the two buckle portions together. There are two side slanted and/or curved surfaces on two longitudinal sides of the base bodies. These surfaces are shaped to correspond with the shape of the opposite surface on the other buckle portion, so that when the two buckle portions are connected together, these slanted surfaces oppose each other and form a slideway thereof, which assists with the disengagement of the parts. The buckle portions are disengaged from each other by pressing inward on the ends of the buckle portions to slide the buckle portions in opposite directions from each other, parallel to the longitudinal direction of the buckles, until the fastening wedges exit the fastening hooks. The force needed to move the buckle parts to disengage them must exceed the magnetic force holding the two buckle parts together, as well as the frictional force connecting the fastening wedge to the fastening hook. The slanted side surfaces provide additional force to disengage the buckle portions from each other as the buckle portions are slid in opposite directions, as the slanted and/or curved surfaces form a ramp that the opposite buckle position slides against. These side slanted surfaces also assist in aligning the buckle portions with each other during engagement of the buckle portions. Even if the portions are not initially aligned, as the magnets pull the buckle portions toward each other, the opposing slanted surfaces slide against each other and force the two buckle portions into alignment so that the hooks engage the fastening wedges and secure the buckle portions together.

To keep the fastening hooks and fastening wedges engaged, the magnets engage to each other when the interior surfaces of the buckle portions are placed together Each fastening wedge engages into the fastening hook in a corresponding one of the buckle portions when the two buckle portions are connected. The side slanted surface allows one portion to slide more easily out of another portion when sufficient longitudinal force is applied to disengage the buckle portions from each other.

To assist in the disengagement of the buckle portions with respect to each other, the buckle portions are shaped so that an end edge of the first buckle portion at one longitudinal end, and an opposite end edge of the second buckle portion extend beyond the opposing end edges of the second and first buckle portions respectively, when the Iwo buckle portions are connected together. This way, the outwardly extending end edges are more easily gripped and pressed by the user to disengage the buckle portions.

Preferably, each of the first and second buckle portions have at least one strap-retaining bar connected to the base body at the end having the fastening recess to allow the buckle portions to be connected to other objects.

In one embodiment, the fastening hook at least on one buckle portion extends entirely though the base body of the other buckle portion, so that the fastening hook is visible from the exterior surfaces of other buckle portion when the buckle portions are locked to each other.

A cover can be attached to one or both of the base bodies to cover the exterior surfaces thereof.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
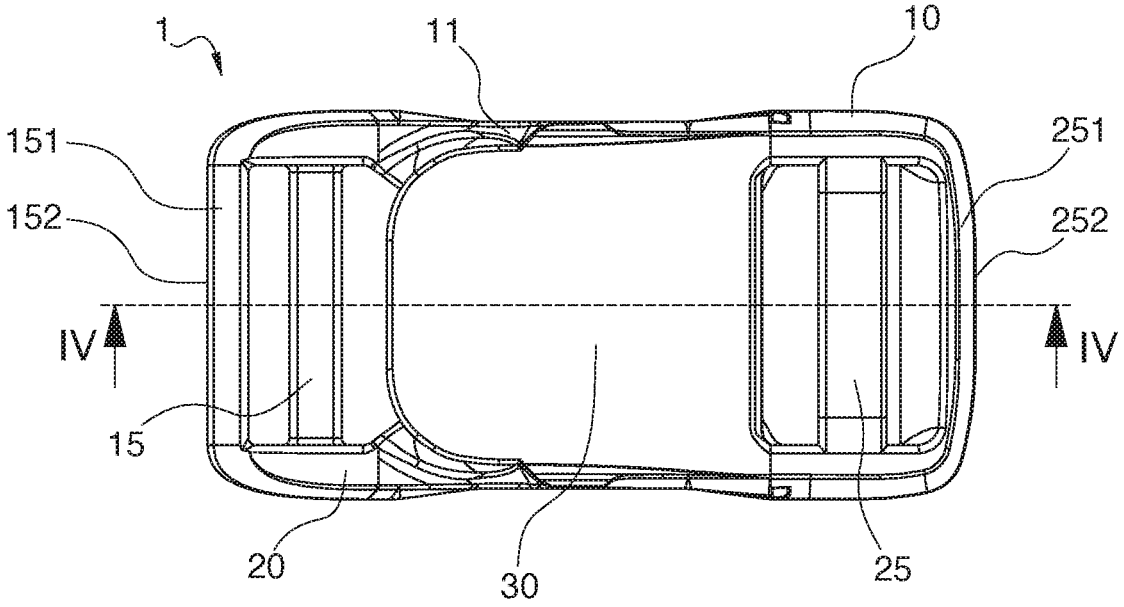
FIG. 1 shows a top view of the buckle assembly according to the invention.
Figure 2:
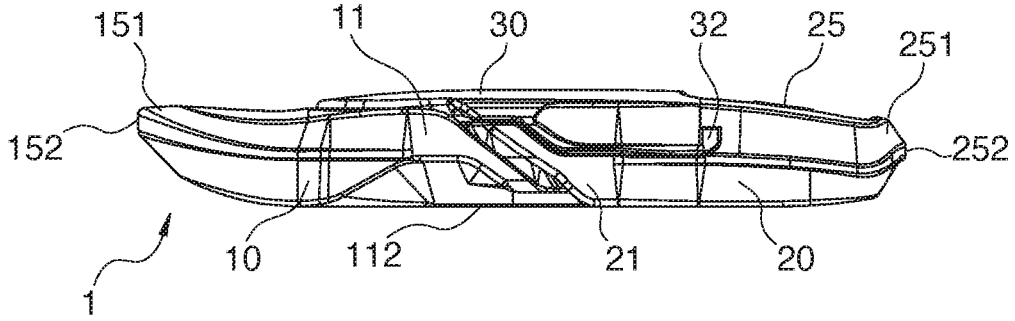
FIG. 2 shows a side view of the buckle assembly.

Referring now in detail to the drawings, FIGS. 1-5 show the buckle assembly 1 according to the invention. Buckle assembly 1 comprises a first buckle portion 10 and a second buckle portion 20. Buckle portion 10 has a base body 11, having a plurality of exterior surfaces 112 and a plurality of interior surfaces 111. Buckle portion 20 has a base body 21 with a plurality of exterior surfaces 212 and a plurality of interior surfaces 211. On their respective outer edges, which extend beyond the overlapping portions of base bodies 11, 21, are strap retaining bars 15, 25, respectively. Two additional strap retaining bars 151, 251 are also present on buckle portions 10, 20, respectively, to allow for adjustability of straps connected thereto.

In another embodiment (not shown), strap retaining bar 151 can be configured identical to strap retaining bar 251, to allow adjustability of the straps on both buckle portions.

Figure 4:
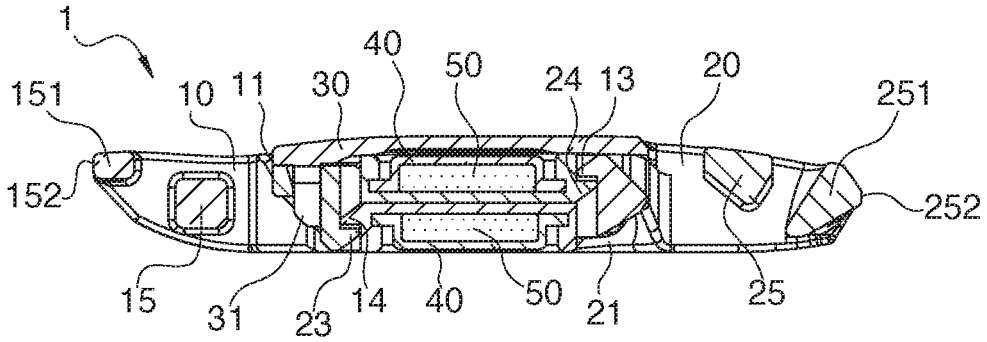
FIG. 4 shows a cross-sectional view along lines IV-IV of FIG. 1.
Figure 13:
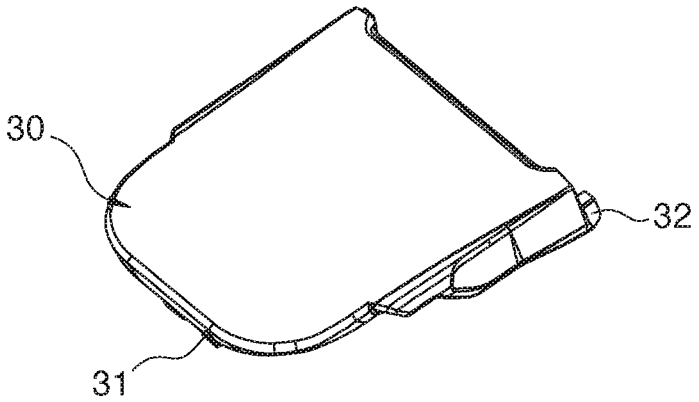
FIG. 13 shows a top and side perspective view of a cover for connection to one of the buckle portions.
Figure 14:
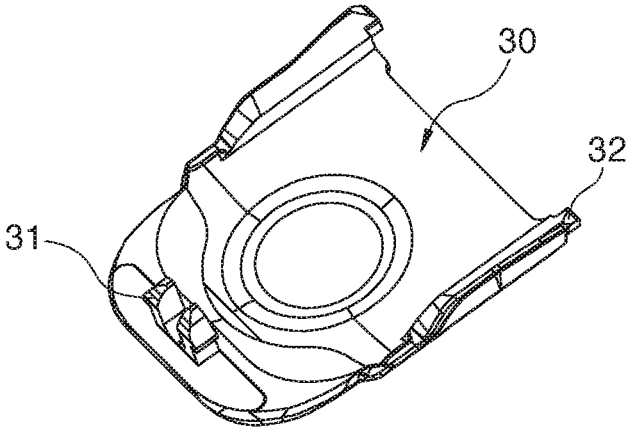
FIG. 14 shows a bottom and side perspective view of the cover.
Figure 15:
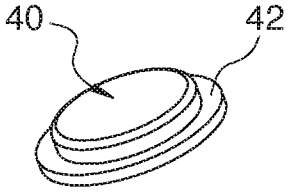
FIG. 15 shows a top and side perspective view of the magnet enclosure.
Figure 16:
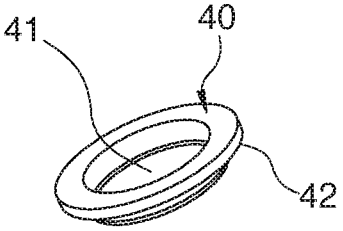
FIG. 16 shows a bottom and side perspective view of the magnet enclosure.

End edge 152 of buckle portion 10 sits at the outer end of base body 11, end edge 252 of buckle portion 20 sits at the end of base body 21 on the opposite side to end edge 152. A cover 30, shown in FIGS. 13 and 14, is connected to base body 21 of second buckle portion 20, by protrusions 32 snapping into recess 29 (see FIG. 6) of base body 21. The other end of cover 39 is connected to base body 21 by snapping prongs 31 into recess 28 if hook 23 (See FIG. 5) to secure the cover immovably on base body 21, as can be seen in FIG. 4.

The individual buckle portions 10, 20 are shown in detail in FIGS. 5-12. Both buckle portions can be constructed to be identical or can be made to differ in appearance and/or structure, as long as their cooperating features are intact.

Figure 5:
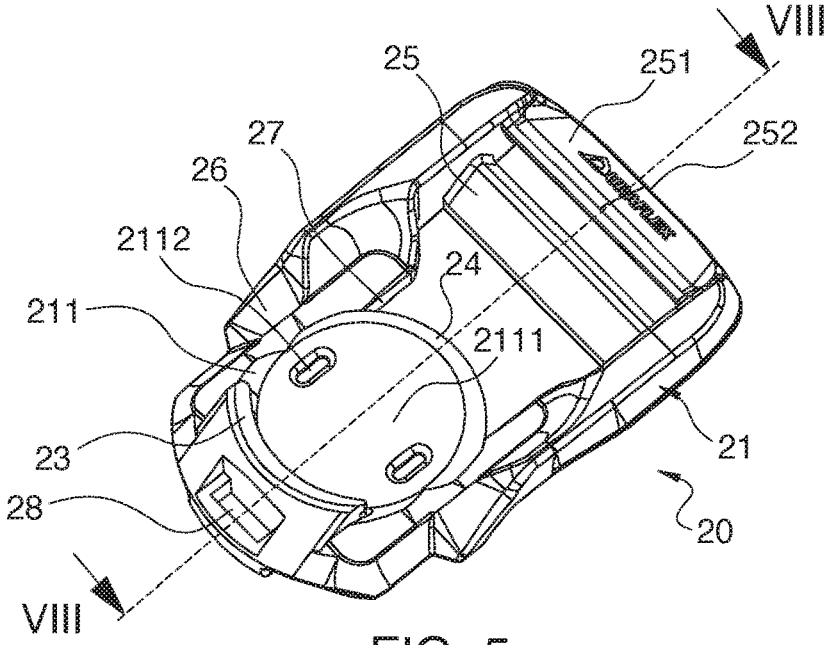
FIG. 5 shows a bottom and side perspective view of a second buckle portion according to the invention.
Figure 6:
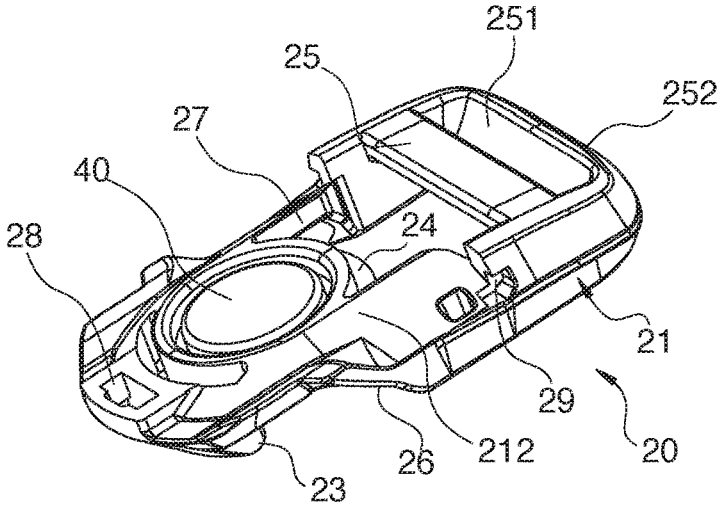
FIG. 6 shows a top and side perspective view of the second buckle portion.
Figure 7:
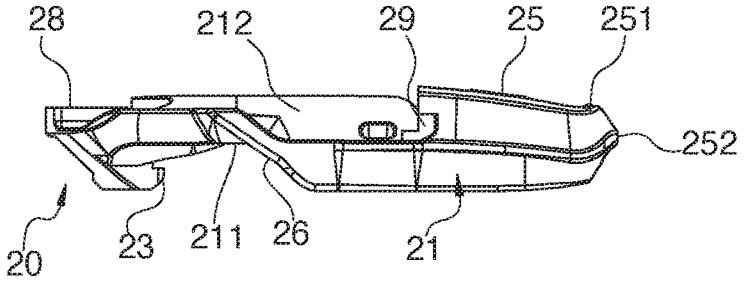
FIG. 7 shows a side view of the second buckle portion.
Figure 8:
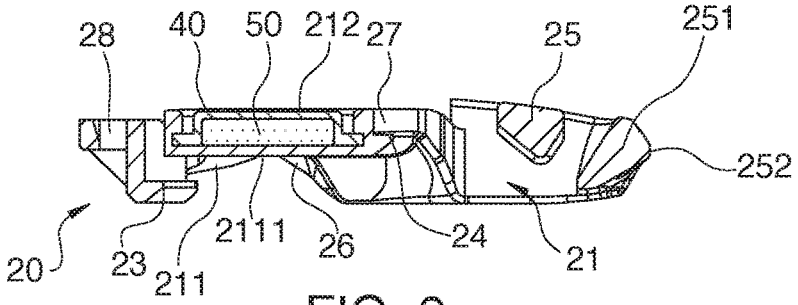
FIG. 8 shows a cross-sectional view along lines VIII-VIII of FIG. 5.

FIGS. 5-8 and 13-16 show buckle portion 20 in its unassembled state. As shown in FIG. 5, base body 21 has an opening 27 with a fastening wedge 24 near a circular flat 2111. On the opposite side of circular flat 2111 is a fastening hook 23, which extends upward from interior surfaces 211. Fastening hook 23 is arc-shaped. There are two side slanted surfaces 26 extending from circular flat 2111. As shown in FIG. 8, a magnet 50 is disposed in a cavity 41 (FIG. 16) of the enclosure 40 and it is embedded in base body 21 under circular flat 2111. Circular flat 2111 contains slots 2112 (FIG. 5) for locating the magnet 50 and enclosure 40 assembly in a mold during manufacturing process. As shown in FIG. 6, opening 27 extends entirely through exterior surfaces 212 so that fastening wedge 24 is visible from exterior surface 212 of buckle portion 20 while the cover 30 is not assembled into buckle portion 20.

When straps are wrapped around strap retaining bars 151, 251, the structure and tenacity of the straps prevent buckle portions 10, 20 from flipping over due to magnetic attraction between their exterior surfaces 112 and 212 during engagement of the buckle portions.

Figure 9:
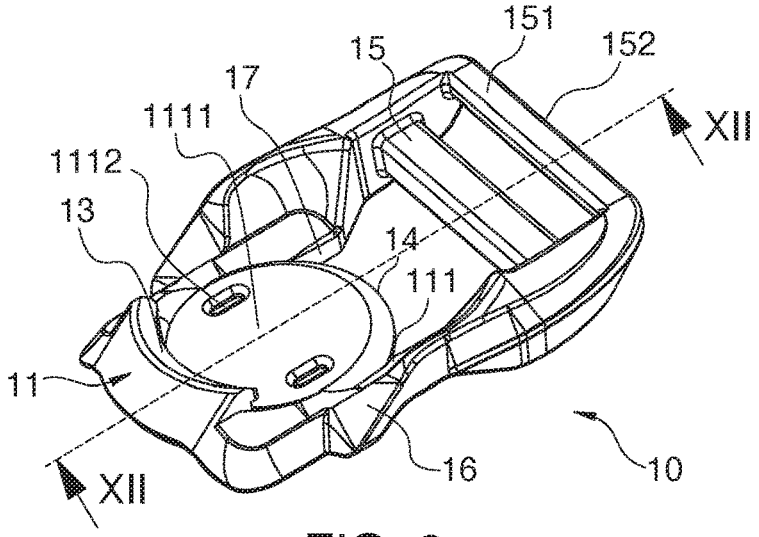
FIG. 9 shows a bottom and side perspective view of the first buckle portion.
Figure 10:
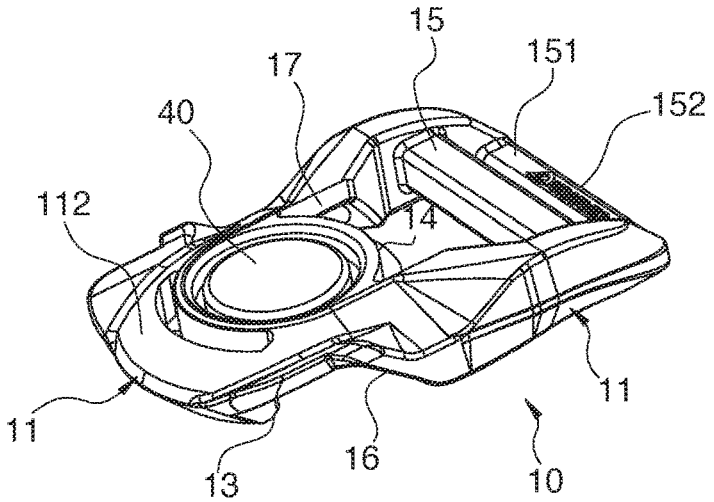
FIG. 10 shows a top and side perspective view of the first buckle portion.
Figure 11:
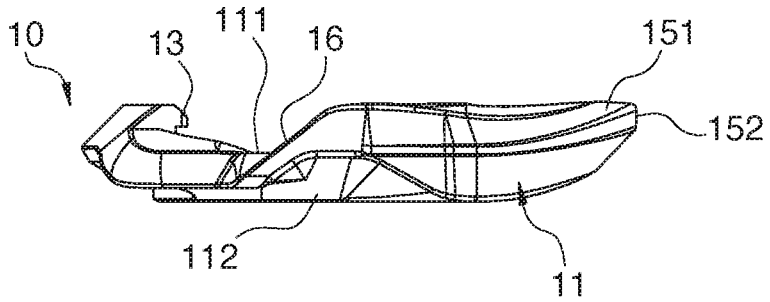
FIG. 11 shows a side view of the first buckle portion.
Figure 12:
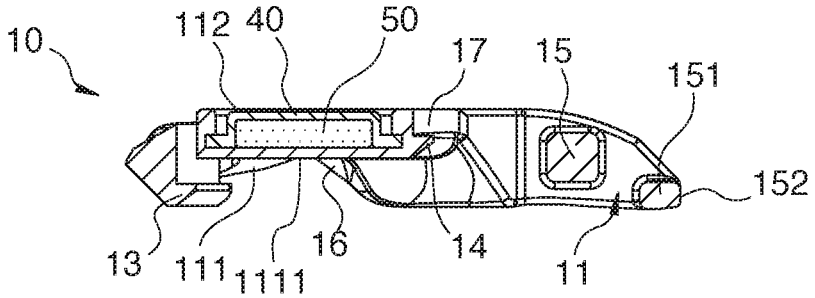
FIG. 12 shows a cross-sectional view along lines XII-XII of FIG. 9.

FIGS. 9-12 & 15-16 show buckle portion 10 in its unassembled state. As shown in FIG. 9, buckle body 11 has an opening 17 with a fastening wedge 14 near circular flat 1111. On the opposite side of circular Bat 1111 is a fastening hook 13, which extends upward from interior surfaces 111. Fastening hook 13 is arc-shaped. There are two side slanted surfaces 16 extend from circular flat 1111. As shown in FIG. 12, a magnet 50 is disposed in a cavity 41 (FIG. 16) of the enclosure 40 and is embedded in buckle body 11 under circular flat 1111. Circular flat 1111 contains slots 1112 (FIG. 9) for locating the magnet 50 and enclosure 40 in a mold during manufacturing process. As shown in FIG. 10, opening 17 extends entirely through exterior surface 112 so that fastening wedge 24 is visible from exterior surface 112 of buckle portion 10.

The operation of buckle assembly 10 is described as follows with particular reference to FIGS. 4, 5 & 9: To assemble buckle portion 10 and buckle portion 20, the two buckle portions are placed together with their interior surfaces 111, 211 facing each other and the strap retaining bars 15, 25 on opposite ends. The attractive force of the magnets 50 on each of the buckle portions 10, 20 draws the buckle portions 10, 20 together so that side slanted surfaces 16 collide with side slanted surfaces 26. The slanted surfaces 16, 26 collide and slide against each other and help to guide the two buckle portions into the correct engagement position. Slanted surfaces 16, 26 also have correspondingly curved contours to further assist in guiding the buckle portions 10, 20 into proper alignment. Once the two buckle portions are connected, the fastening hook 13 of the first buckle portion 10 extends into opening 27 of second buckle portion 20 and then engages with fastening wedge 24. Similarly, on the other side, side slanted surfaces 26 collide with side slanted surfaces 16, then each buckle portion 10, 20 adjusts along another side slanted surfaces 16, 26. The fastening hook 23 of second buckle portion 20 extends into opening 17 of first buckle portion 10 and engages with fastening wedge 14. The secure engagement of the fastening hooks 13, 23 in the openings 27, 17, respectively prevents disengagement of the buckle portions 10, 20 when force is applied in the longitudinal direction L, such as by tension on straps (not shown) connected to bars 15, 25.

Figure 3:
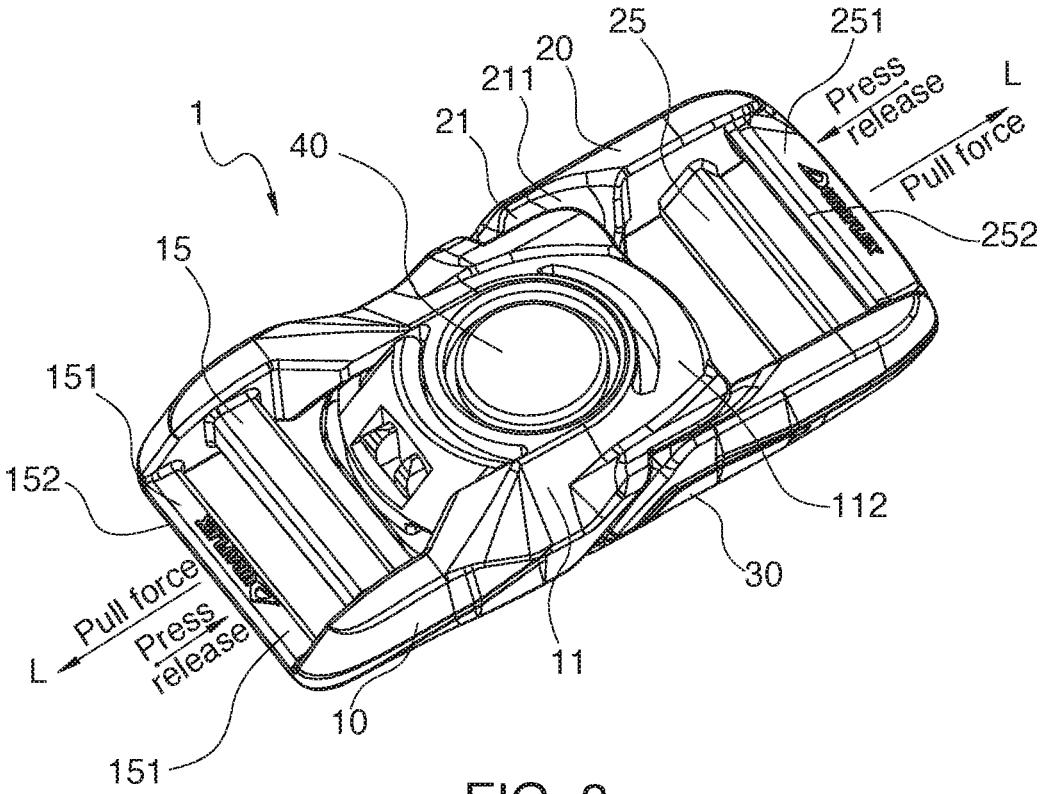
FIG. 3 shows a bottom and side perspective view of the buckle assembly.

To disengage the buckle portions 10, 20, the user presses inward simultaneously on the end edges 152, 252 of buckle portions 10, 20 respectively in the direction of the inwardly facing arrows in FIG. 3, parallel to the longitudinal direction L, so that the buckle portions are pressed toward each other along this direction. This makes buckle portions 10, 20, slide longitudinally relative to each other, toward the center of the buckle assembly. As the buckle portions slide longitudinally, the fastening hooks 13, 23 of each buckle portion also slides longitudinally until side slanted surfaces 16, 26 contact together. At this point, each buckle portion 10, 20 slides along the sloped contour of side slanted surfaces 16, 26, which forces the two buckle portions away from each other. In addition, the longitudinal sliding has broken the attraction between the two magnets 50, and the two buckle portions 10, 20 can easily be released from each other. Under pulling tension in direction L along the arrows in FIG. 3 that point away from each other, the buckle portions remain locked together, with the fastening hooks 13, 23 firmly engaged in fastening wedges 24, 14, respectively.

The present invention provides a simple and secure way to attach two buckle parts together, without requiring a large amount of force to disengage the parts and without requiring any moving parts in the buckle.

Accordingly, while only a few embodiments of the present invention have been shown and described, it is obvious that many changes and modifications may be made thereunto without departing from the spirit and scope of the invention.

What is claimed is:

1. A buckle assembly comprising:

a first buckle portion comprising a first base body with a plurality of exterior surfaces, and a plurality of interior surfaces that extend from a first central circular flat, a first fastening hook on one longitudinal end of the first base body and a first fastening opening with a first fastening wedge on another longitudinal end of the first base body on an opposite side of the first circular flat from the first fastening hook, the first opening extending through the first base body, and a magnet enclosed in the first base body under the first circular flat;

a second buckle portion comprising a second base body with a plurality of exterior surfaces, and a plurality of interior surfaces that extend from a second central circular flat, a second fastening hook on one longitudinal end of the second base body and a second fastening opening with a second fastening wedge on another longitudinal end of the second base body on an opposite side of the second central circular flat from the second fastening hook, the second opening extending through the second base body, and a magnet enclosed in the second base body under the second central circular flat, and a cover connected to one of the buckle portions, the cover extending over at least some of the plurality of exterior surfaces of the one buckle portion, wherein the first and second buckle portions are configured such that placing the interior surfaces of the first buckle portion against the interior surfaces of the second buckle portion causes the magnets to engage each other and the fastening hooks of each buckle portion to enter the fastening openings of the other buckle portion, to lock the two buckle portions together and prevent disengagement under tension in opposing directions parallel to a longitudinal extent of the buckle assembly.

2. The buckle assembly according to claim 1, wherein the first and second fastening wedges are connected to the first and second base bodies respectively and extend into the first and second fastening openings respectively, and wherein the first and second fastening hooks engage a respective one of the fastening wedges on an opposite one of the buckle portions as the fastening hooks enter the fastening openings to lock the two buckle portions together.

3. The buckle assembly according to claim 1, wherein each of the buckle portions comprises a slanted surface on each longitudinal side, wherein the slanted surfaces of one buckle portion align with the slanted surfaces of the other buckle portion when the buckle portions are connected together and wherein when the buckle portions are pressed in opposite directions from each other parallel to a longitudinal direction of the buckle portions, the slanted surfaces of the first buckle portion slide against the slanted surfaces of the second buckle portion until the fastening wedges exit the fastening hooks to release the buckle portions from a locked position.

4. The buckle assembly according to claim 1, wherein the buckle portions are shaped so that an edge of the first buckle portion at one longitudinal end of the buckle assembly extends beyond an edge of the second buckle portion at the same longitudinal end of the buckle assembly, and an opposite edge of the second buckle portion extends beyond an edge of the first buckle portion at the same longitudinal end of the buckle assembly when the two buckle portions are connected together.

5. The buckle assembly according to claim 1, wherein each of the first and second buckle portions have at least one strap-retaining bar connected to the base body at an end closer to the fastening opening recess, the at least one strap retaining bar being configured to allow the buckle portions to be connected to other objects.

6. The buckle assembly according to claim 1, wherein the fastening hook of at least one of the buckle portions extends entirely though the base body of the other buckle portion when the buckle portions are fastened together, so that the fastening hooks are visible from the exterior surfaces of the other buckle portion.

7. The buckle assembly according to claim 1, wherein at least one of the fastening hooks is arc-shaped.

* * * * *